United States Patent [19]

Sato et al.

[11] 4,147,553

[45] Apr. 3, 1979

[54] SUPERSENSITIZED PHOTOGRAPHIC EMULSION

[75] Inventors: Akira Sato; Tadashi Ikeda; Takeo Sakai; Haruo Takei; Jun Hayashi, all of Minami-ashigara, Japan

[73] Assignee: Fuji Photo Film Co., Ltd., Minami-ashigara, Japan

[21] Appl. No.: 875,728

[22] Filed: Feb. 7, 1978

[30] Foreign Application Priority Data

Feb. 10, 1977 [JP] Japan ..... 52/13598

[51] Int. Cl.[2] ..... G03C 1/08

[52] U.S. Cl. ..... 96/122; 96/124; 96/126; 96/109

[58] Field of Search ..... 96/124, 126, 122, 109

[56] References Cited

U.S. PATENT DOCUMENTS

| | | | |
|---|---|---|---|
| 2,226,158 | 12/1940 | Davey | 96/126 |
| 2,945,763 | 7/1960 | Jones | 96/126 |
| 3,922,170 | 11/1975 | Shiba et al. | 96/124 |
| 3,977,882 | 8/1976 | Shiba et al. | 96/124 |

*Primary Examiner*—J. Travis Brown

*Attorney, Agent, or Firm*—Sughrue, Rothwell, Mion, Zinn and Macpeak

[57] ABSTRACT

A silver halide photographic emulsion containing, in supersensitizing amounts, the combination of at least one compound represented by the following general formula (I):

(I)

wherein $Z_1$ represents the atoms necessary for forming a benzene ring or a naphthalene ring; $W_1$ represents a sulfur atom or a selenium atom; Y represents an oxygen atom or a sulfur atom; $R_1$ represents an alkyl group or an aryl group; and $R_2$ represents a lower alkyl group having 1 to 6 carbon atoms in the alkyl moiety or an aryl group;

at least one carbocyanine dye represented by the following general formula (II):

(II)

wherein $Z_2$ represents the atoms necessary for forming a thiazole ring, a selenazole ring, an oxazole ring, an imidazole ring or a pyrroline ring; $Z_3$ represents the atoms necessary for forming an oxazole ring or an imidazole ring; $R_4$ and $R_5$, which may be the same or different, each represents an alkyl group; $R_6$ represents a hydrogen atom or a lower alkyl group having 1 to 6 carbon atoms in the alkyl moiety; $X_a^{\ominus}$ represents an acid anion; and p represents 0 or 1 and, when an inner salt is formed, p represents 0; and at least one dye represented by the following general formula (III):

(III)

wherein $Z_4$ and $Z_5$, which may be the same or different, each represents the atoms necessary for forming a thiazole ring or a selenazole ring; $R_7$ and $R_8$, which may be the same or different, each represents an alkyl group; $R_9$ represents a hydrogen atom, a lower alkyl group having 1 to 6 carbon atoms in the alkyl moiety or an aryl group; $X_b^{\ominus}$ represents an acid anion; and q represents 0 or 1 and, when an inner salt is formed, q represents 0.

14 Claims, No Drawings

SUPERSENSITIZED PHOTOGRAPHIC EMULSION

BACKGROUND OF THE INVENTION

1. Field of the Invention

The present invention relates to a spectrally sensitized silver halide photographic emulsion and, more particularly, it relates to a silver halide photographic emulsion spectrally sensitized by using a combination of at least two or more sensitizing dyes.

2. Description of the Prior Art

In spectrally sensitizing silver halide emulsions, it is known that the combination of a certain sensitizing dye and another sensitizing dye or a compound other than a sensitizing dye markedly increases the efficiency of spectral sensitization to provide high sensitivity. This effect is called supersensitization. Various combinations of sensitizing dyes have been suggested for the purpose of supersenitization. However, it is also known that, with respect to a combination of two or more sensitizing dyes providing supersensitization, the dyes are so selective together that it is extremely difficult to predict that a supersensitizing action will be obtained from the chemical structure of the sensitizing dyes.

On the other hand, supersensitization using a combination of two or more sensitizing dyes often causes a reduction in spectral sensitivity in a specific spectrally sensitized wavelength region, an increase in fog, a deterioration of stability with time such as a reduction in sensitivity or increase in fog during or after production of the light-sensitive materials, a deterioration of latent image stability between photographic exposure and development, and like defects. Achieving supersensitization using a combination of sensitizing dyes which does not cause these detrimental actions has been an important subject in the field of producing light-sensitive materials.

SUMMARY OF THE INVENTION

An object of the present invention is to provide a silver halide photographic emulsion supersensitized with a novel combination of three different dyes.

Another object of the present invention is to provide a spectrally sensitized silver halide photographic emulsion in which a reduction in sensitivity or an increase in fog during storage of the light-sensitive materials, in particular, during storage under conditions of high temperature and high humidity, does not occur.

The above-described objects of the invention have been attained with a silver halide photographic emulsion containing, in combination, in supersensitizing amounts, at least one compound represented by the following general formula (I):

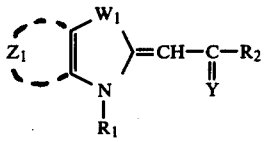

(I)

wherein $Z_1$ represents the atoms necessary for forming a benzene ring or a naphthalene ring; $W_1$ represents a sulfur atom or a selenium atom; Y represents an oxygen atom or a sulfur atom; $R_1$ represents an alkyl group or an aryl group; and $R_2$ represents a lower alkyl group having 1 to 6 carbon atoms in the alkyl moiety or an aryl group;

at least one carbocyanine dye represented by the following general formula (II):

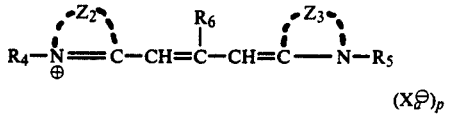

(II)

wherein $Z_2$ represents the atoms necessary for forming a thiazole ring, a selenazole ring, an oxazole ring, an imidazole ring or a pyrroline ring; $Z_3$ represents the atoms necessary for forming an oxazole ring or an imidazole ring; $R_4$ and $R_5$, which may be the same or different, each represents an alkyl group; $R_6$ represents a hydrogen atom or a lower alkyl group having 1 to 6 carbon atoms in the alkyl moiety; $X_a^{\ominus}$ represents an acid anion; and p represents 0 or 1 and, when an inner salt is formed, p represents 0; and at least one dye represented by the following general formula (III):

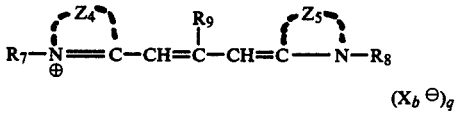

(III)

wherein $Z_4$ and $Z_5$, which may be the same or different, each represents the atoms necessary for forming a thiazole ring or a selenazole ring; $R_7$ and $R_8$, which may be the same or different, each represents an alkyl group; $R_9$ represents a hydrogen atom, a lower alkyl group having 1 to 6 carbon atoms in the alkyl moiety or an aryl group; $X_b^{\ominus}$ represents an acid anion; and q represents 0 or 1 and, when an inner salt is formed, q represents 0.

DETAILED DESCRIPTION OF THE INVENTION

In the general formula (I), $Z_1$ represents the atoms necessary to form a benzene ring or a naphthalene ring which may be substituted with, for example, one or more of a straight chain, branched chain or cyclic alkyl group having 1 to 10 carbon atoms (e.g., a methyl group, an ethyl group, a propyl group, a butyl group, a decyl group, etc.), an alkoxy group having 1 to 8 carbon atoms in which the alkyl moiety may be straight chain, branched chain or cyclic (e.g., a methoxy group, an ethoxy group, a propoxy group, a butoxy group, etc.), a halogen atom (e.g., a chlorine atom, a bromine atom, an iodine atom, etc.), a cyano group, an unsubstituted or substituted phenyl group (e.g., a phenyl group, a tolyl group, a p-methoxyphenyl group, a p-chlorophenyl group, etc.), an alkylcarbonyl group having 2 to 8 carbon atoms, an arylcarbonyl group having 7 to 8 carbon atoms (e.g., an acetyl group, a benzoyl group, a propionyl group, etc.), a methylenedioxy group, an unsubstituted or substituted phenoxy group (e.g., a phenoxy group, a p-methylphenoxy group, a p-methoxyphenoxy group, etc.), an aralkyl group having 7 to 12 carbon atoms in which the aryl moiety may be monocyclic or bicyclic (e.g., a benzyl group, a phenethyl group, a naphthylethyl group, etc.), an alkoxycarbonyl group having 2 to 6 carbon atoms in which the alkyl moiety may be straight chain, branched chain or cyclic (e.g., a methoxycarbonyl group, an ethoxycarbonyl group, etc.), an alkylcarbonylamino group having 2 to 8 carbon atoms, an arylcarbonylamino group having 7 to 8 carbon atoms (e.g., an acetylamino group, a propionylamino group, etc.), a carbamoyl group having 1 to 8 carbon atoms (e.g., a carbamoyl group, a methylaminocarbonyl group, an ethylaminocarbonyl group, a dimethylaminocarbonyl group, a diethylaminocarbonyl group, a morpholinocarbonyl group, etc.), a carboxy group, a hydroxy group, etc. In the present invention, $Z_1$ preferably forms a naphthalene ring.

The alkyl group represented by $R_1$ has 1 to 20 total carbon atoms, may be straight chain, branched chain or cyclic and may be substituted. Examples of suitable substituents include one or more of a vinyl group, a sulfo group, a carboxy group, an aryl group, an amino group (which may be a mono- or di-substituted amino group), a hydroxy group, an alkoxy group, an aryloxy group, an alkoxycarbonyl group, an alkylcarbonyloxy group, an arylcarbonyloxy group, a halogen atom, an alkylcarbonyl group, an arylcarbonyl group, an alkylsulfonyl group, an arylsulfonyl group, a carbamoyl group, a cyano group, etc.

The aryl group represented by $R_1$ and $R_2$ has 6 to 12 total carbon atoms, can be monocyclic or bicyclic, and may be substituted. Examples of suitable substituents include one or more of an alkyl group (e.g., having 1 to 4 carbon atoms), a sulfo group, a carboxy group, a halogen atom (e.g., a chlorine atom, a bromine atom, an iodine atom, etc.), an alkoxy group (e.g., having 1 to 4 carbon atoms), a dialkylamino group (e.g., having 2 to 6 total carbon atoms), etc.

The lower alkyl group represented by $R_2$ can be an unsubstituted lower alkyl group having 1 to 6 carbon atoms and may be straight chain, branched chain or cyclic, or a substituted lower alkyl group having 1 to 8 total carbon atoms in which the alkyl moiety may be straight chain, branched chain or cyclic. Examples of suitable substituents include one or more of, e.g., a carboxy group, a cyano group, a fluorine atom, a phenyl group which may be substituted (e.g., a phenyl group, a tolyl group, etc.), an alkoxy group (e.g., having 1 to 4 carbon atoms in which the alkyl moiety may be straight chain, branched chain or cyclic such as a methoxy group, an ethoxy group, a butoxy group, etc.), etc.

In the general formula (II), $Z_2$ represents the atoms necessary to form a thiazole ring, a selenazole ring, an oxazole ring, an imidazole ring or a pyrroline ring and $Z_3$ represents the atoms necessary for forming an oxazole ring or an imidazole ring.

An aromatic ring which can be a monocyclic or bicyclic aromatic ring (such as a benzene ring or a naphthalene ring) or a 5- or 6-membered monocyclic aliphatic ring (such as a cyclopentene ring or a cyclohexene ring) may be fused to the thiazole ring, the selenazole ring, the oxazole ring or the pyrroline ring formed by $Z_2$ and to the oxazole ring formed by $Z_3$ and, in addition, the carbon atoms of these rings may also be substituted with one or more substituents. Illustrative examples of such substituents include a halogen atom (e.g., a chlorine atom, a bromine atom, an iodine atom, etc.), an alkyl group (e.g., having 1 to 6 carbon atoms, preferably 1 to 4 carbon atoms, such as a methyl group, an ethyl group, a propyl group, a butyl group, etc.), a carboxy group, an alkoxycarbonyl group (e.g., having 2 to 6 carbon atoms, such as a methoxycarbonyl group, an ethoxycarbonyl group, a butoxycarbonyl group, etc.), a hydroxy group, a phenyl group, an alkoxy group (e.g., having 1 to 4 carbon atoms such as a methoxy group, an ethoxy group, a butoxy group, etc.), an alkylenedioxy group (e.g., having 1 to 3 carbon atoms), an aralkyl group (e.g., having 7 to 10 carbon atoms, such as a benzyl group, a p-methylbenzyl group, etc.), an alkylcarbonylamino group (e.g., having 2 to 8 carbon atoms, such as an acetylamino group, a propionylamino group, a butyrylamino group, etc.) and an arylcarbonylamino group (e.g., having 7 to 8 carbon atoms, such as a benzoylamino group, a p-methylbenzoylamino group, etc.).

The imidazole ring formed by $Z_2$ or $Z_3$ may be fused with a monocyclic or bicyclic aromatic ring such as a benzene ring or a naphthalene ring, and the carbon atoms of these rings may also be substituted with one or more substituents. Examples of suitable substituents include a halogen atom (e.g., a chlorine atom, a bromine atom, an iodine atom, etc.), a cyano group, a trifluoromethyl group, an alkylsulfonyl group (e.g., having 1 to 4 carbon atoms, such as a methylsulfonyl group, an ethylsulfonyl group, etc.), an alkoxycarbonyl group (e.g., having 2 to 5 carbon atoms, such as a methoxycarbonyl group, an ethoxycarbonyl group, a butoxycarbonyl group, etc.), a carboxy group, an alkylcarbonyl group (e.g., having 2 to 5 carbon atoms, such as an acetyl group, a propionyl group, etc.), etc.

In the general formula (III), $Z_4$ and $Z_5$ represents the atoms necessary to form a thiazole ring or a selenazole ring which may be fused with a monocyclic or bicyclic aromatic ring (such as a benzene ring or a naphthalene ring) or with a 5- or 6-membered monocyclic aliphatic ring (such as a cyclopentene ring or a cyclohexene ring), and the carbon atoms of these rings may also be substituted with one or more substituents. Examples of substituents are those described above with respect to $Z_2$ or $Z_3$.

Illustrative examples of hetero ring nuclei containing a thiazole nucleus for general formula (I) and formed by $Z_2$, $Z_4$ or $Z_5$ are thiazole rings (e.g., thiazole, 4-methylthiazole, 4-phenylthiazole, 5-methylthiazole, 5-phenylthiazole, 4,5-dimethylthiazole, etc.), benzothiazole rings (e.g., benzothiazole, 4-chlorobenzothiazole, 5-chlorobenzothiazole, 6-chlorobenzothiazole, 5-methylbenzothiazole, 6-methylbenzothiazole, 5,6-dimethylbenzothiazole, 5-bromobenzothiazole, 5-carboxybenzothiazole, 5-ethoxycarbonylbenzothiazole, 5-hydroxybenzothiazole, 5-phenylbenzothiazole, 4-methoxybenzothiazole, 5-methoxybenzothiazole, 6-methoxybenzothiazole, 5-iodobenzothiazole, 5-ethoxybenzothiazole, tetrahydrobenzothiazole, 5,6-dimethoxybenzothiazole, 5,6-methylenedioxybenzothiazole, 6-ethoxy-5-methylbenzothiazole, 5-phenethylbenzothiazole, 6-acetylaminobenzothiazole, etc.), naphthothiazole rings (e.g., naphtho[1,2-d]thiazole, naphtho[2,1-d]thiazole, naphtho[2,3-d]thiazole, 5-methoxynaphtho[1,2-d]thiazole, 8-methoxynaphtho[2,1-d]thiazole, 7-methoxynaphtho[2,1-d]thiazole, 5-methoxythionaphtheno[6,7-d]thiazole, 8,9-dihydronaphtho[1,2-d]thiazole, 4,5-dihydronaphtho[2,1-d]thiazole, etc.), etc.

Examples of hetero ring nuclei containing a selenazole nucleus formed by $Z_1$, $Z_2$, $Z_4$ or $Z_5$ are selenazole rings (e.g., selenazole, 4-methylselenazole, 4-phenylselenazole, etc.), benzoselenazole rings (e.g., benzoselenazole, 5-chlorobenzoselenazole, 5-methoxybenzoselenazole, 5-methylbenzoselenazole, 4,5,6,7-tetrahydrobenzoselenazole, etc.), naphthoselenazole rings (e.g., naphtho[1,2-d]selenazole, naphtho[2,1-d]selenazole, naphtho[2,3-d]selenazole, 8,9-dihydronaphtho[1,2-d]selenazole, etc.), etc.

Examples of hetero ring nuclei containing an oxazole nucleus formed by $Z_2$ or $Z_3$ are oxazole rings (e.g., oxazole, 4-methyloxazole, 5-methyloxazole, 4-phenyloxazole, 4,5-dimethyloxazole, 5-phenyloxazole, etc.), benzoxazole rings (e.g., benzoxazole, 5-chlorobenzoxazole, 5-methylbenzoxazole, 5-phenylbenzoxazole, 6-methylbenzoxazole, 5,6-dimethylbenzoxazole, 5-methoxybenzoxazole, 5-ethoxybenzoxazole, 5-phenethylbenzoxazole, 5-carboxybenzoxazole, 5-hydroxybenzoxazole, 5-ethoxycarbonylbenzoxazole, 5-bromobenzoxazole, 5-methyl-6-chlorobenzoxazole, etc.), naphthoxazole rings (e.g., naphtho[1,2-d]oxazole, naphtho[2,1-d]oxazole, naphtho[2,3-d]oxazole, etc.), etc.

Examples of hetero ring nuclei comprising a pyrroline ring formed by $Z_2$ are a 3,3-dialkylindolenine nucleus such as 3,3-dimethylindolenine, 3,3,5-trimethylindolenine, 3,3-dimethyl-5-(dimethylamino)indolenine, 3,3-diethylindolenine, etc.

Specific examples of hetero ring nuclei comprising an imidazole ring completed by $Z_2$ or $Z_3$ are 1-substituted imidazole rings (e.g., 1-alkylimidazole, 1-alkyl-4-phenyl-imidazole, 1-alkyl-4,5-dimethylimidazole, etc.), 1-substituted-benzimidazole rings (e.g., 1-alkylbenzimidazole, 1-phenyl-5,6-dichlorobenzimidazole, 1-alkyl-5-cyanobenzimidazole, 1-alkyl-5-chlorobenzimidazole, 1-alkyl-5,6-dichlorobenzimidazole, 1-alkyl-5-trifluoromethylbenzimidazole, 1-alkyl-5-methylsulfonylbenzimidazole, 1-alkyl-5-methoxycarbonylbenzimidazole, 1-alkyl-5-acetylbenzimidazole, 1-alkyl-5-carboxybenzimidazole, etc.), 1-substituted-naphthimidazole rings (e.g., 1-alkylnaphtho[1,2-d]imidazole, 1-alkylnaphtho[2,1-d]imidazole, 1-alkylnaphtho[2,3-d]imidazole, etc.), etc. In the above description, the 1-alkyl group can be an alkyl group having 1 to 4 carbon atoms (e.g., methyl, ethyl, propyl, butyl, etc.) which may be either unsubstituted or substituted with one or more of, e.g., an alkoxy group (e.g., having 1 to 6 carbon atoms), an alkoxycarbonyl group (e.g., having 1 to 4 carbon atoms in the alkoxy moiety), a carboxy group, a carbamoyl group, a cyano group, a halogen atom, a sulfo group, a phenyl group, a substituted phenyl group (e.g., substituted with a methyl group, an ethyl group, a methoxy group, a chlorine atom, a sulfo group, a carboxy group, etc.), a vinyl group, etc. Specific examples of these alkyl groups which can be substituted in the 1-position include a methyl group, an ethyl group, a cyclohexyl group, a butyl group, etc. Examples of substituted alkyl groups which can be substituted in the 1-position include alkoxyalkyl groups such as a methoxyethyl group, an ethoxyethyl group, a methoxybutyl group, etc., alkoxycarbonylalkyl groups such as a methoxycarbonylmethyl group, an ethoxycarbonylmethyl group, an ethoxycarbonylethyl group, etc., carboxyalkyl groups such as a carboxymethyl group, a carboxyethyl group, a carboxypropyl group, etc., carbamoylalkyl groups such as a carbamoylethyl group, etc., cyanoalkyl groups such as a cyanoethyl group, a cyanopropyl group, etc., haloalkyl groups such as a fluoroethyl group, a 2,2,2-trifluoroethyl group, a 2,2,2,3,3-pentafluoropropyl group, etc., sulfoalkyl groups such as a sulfoethyl group, a sulfopropyl group, a sulfobutyl group, etc., phenyl substituted alkyl groups such as a benzyl group, a phenethyl group, etc., a substituted phenylalkyl groups such as a p-methylphenethyl group, p-methoxyphenethyl group, etc., etc.

The alkyl group represented by $R_4$ and $R_5$ is the same as defined with respect to the alkyl groups of $R_1$ and the lower alkyl group represented by $R_6$ is the same as referred to with respect to $R_2$.

The alkyl group represented by each of $R_7$ and $R_8$ is the same as defined with respect to $R_1$. The lower alkyl group represented by $R_9$ is the same as defined with respect to $R_2$. The aryl group represented by $R_9$ is the same as defined with respect to $R_1$.

Suitable examples of straight chain, branched chain or cyclic alkyl groups represented by $R_1$ are a methyl group, an ethyl group, an n-propyl group, an n-butyl group, an n-hexyl group, an n-octyl group, an n-decyl group, an n-dodecyl group, an n-octadecyl group, a cyclohexyl group, a 2-cyclohexylethyl group, a 2-ethylhexyl group and an isobutyl group, etc.

Suitable examples of substituted alkyl groups represented by $R_1$ in which the alkyl moiety may be straight chain, branched chain or cyclic are vinylalkyl groups such as an allyl group and a 2-butenyl group, etc., sulfoalkyl groups such as a sulfoethyl group, a sulfopropyl group, a sulfobutyl group, a 2-hydroxy-3-sulfopropyl group, a 2-chloro-3-sulfopropyl group, etc., carboxyalkyl groups such as a carboxymethyl group, a carboxyethyl group, a carboxypropyl group, etc., aralkyl groups such as a benzyl group, a phenethyl group, a p-tolylethyl group, a p-t-butylphenethyl group, a p-sulfophenethyl group, a p-sulfobenzyl group, a p-carboxyphenethyl group, etc., aminoalkyl groups such as an N-ethylaminopropyl group, an N,N-dimethylaminoethyl group, a morpholinoethyl group, etc., hydroxyalkyl groups such as a hydroxyethyl group, a hydroxypropyl group, etc., alkoxyalkyl groups such as a methoxyethyl group, an ethoxyethyl group, a 2,3-di(3-sulfopropoxy)propyl group, 2-[2-(3-sulfopropoxy)ethoxy]ethyl group, etc., aryloxyalkyl groups such as a phenoxyethyl group, a phenoxypropyl group, a p-t-butylphenoxyethyl group, a p-methylphenoxyethyl group, etc., alkoxycarbonyl groups such as an ethoxycarbonylmethyl group, an ethoxycarbonylethyl group, etc., alkoxycarbonyloxy groups such as an acetoxyethyl group, an acetoxypropyl group, etc., haloalkyl groups such as a chloropropyl group, a 2,2,2-trifluoroethyl group, a perfluoropropyl group, a chloroethyl group, etc., alkylcarbonylalkyl groups such as an acetylethyl group, a propionylethyl group, etc., alkylsulfonylalkyl groups such as a methylsulfonylethyl group, a benzenesulfonylethyl group, etc., carbamoylalkyl groups such as an N-ethylcarbamoylpropyl group, a carbamoylethyl group, etc., and cyanoalkyl groups such as a cyanoethyl group, a cyanopropyl group, etc., etc.

Specific examples of alkyl groups represented by $R_4$, $R_5$, $R_7$ and $R_8$ are as described for $R_1$ and include a methyl group, an ethyl group, a butyl group, an octyl group, a decyl group, an octadecyl group, a cyclohexyl group, a hydroxyethyl group, a sulfoethyl group, a sulfopropyl group, a δ-sulfobutyl group, a benzyl group, a phenethyl group, a carboxyethyl group, a carboxymethyl group, a dimethylaminopropyl group, a methoxyethyl group, a phenoxypropyl group, a methylsulfonylethyl group, a p-t-butylphenoxyethyl group, a p-sulfophenethyl group, a p-sulfobenzyl group, a 2-hydroxy-3-sulfopropyl group, a 2,3-di(3-sulfopropoxy)propyl group, a 2-[2-(3-sulfopropoxy)ethoxy]ethyl group, a 2-carbamoylethyl group, a p-carboxyphenethyl group, an ethoxycarbonylmethyl group, a propionylethyl group, an acetoxyethyl group, a chloroethyl group, a cyanoethyl group, a morpholinoethyl group, an acetylaminoethyl group, an N-ethylcarbamoylpropyl group, an allyl group, a 2-butenyl group, etc.

Examples of aryl groups represented by $R_1$, $R_2$ and $R_9$ are a phenyl group, a tolyl group, a t-butylphenyl group, a sulfophenyl group, a carboxyphenyl group, a chlorophenyl group, a methoxyphenyl group, an N,N-dimethylaminophenyl group, an N,N-diethylaminophenyl group, a naphthyl group, etc.

Specific examples of lower alkyl groups represented by $R_2$, $R_6$ and $R_9$ are a methyl group, an ethyl group, a butyl group, a cyclohexyl group, a benzyl group, a phenethyl group, a carboxyethyl group, a methoxyethyl group, a trifluoroethyl group, a cyanoethyl group, etc.

More specific examples of alkyl groups represented by $R_6$ and $R_9$ are a methyl group, an ethyl group, a butyl group, a phenethyl group, a tolylethyl group, etc.

Specific examples of anions $X_a$ and $X_b$ in the above-described general formulas include a chloride ion, a bromide ion, an iodide ion, a perchlorate ion, a benzenesulfonate ion, a tosylate ion, a methylsulfate ion, an ethylsulfate ion, a thiocyanate ion, etc. $X_a$ in the general formula (II) may be the same as or different from $X_b$ in the general formula (III).

In the substituents as set forth above for the $R_1$, $R_2$, $R_3$, $R_4$, $R_5$, $R_6$, $R_7$, $R_8$ and $R_9$ groups and as set forth above on the $Z_1$, $Z_2$, $Z_3$, $Z_4$ and $Z_5$ rings, dependent on the carbon range therof recited, the alkyl groups and alkyl moieties can be straight chain, branched chain or cyclic and the aryl groups and aryl moieties can be monocyclic or bicyclic.

Of the compounds represented by the foregoing general formula (I), those wherein Y represents an oxygen atom and $R_2$ represents an unsubstituted or substituted phenyl group (for example, a phenyl group having a methyl group, an ethyl group, an isopropyl group, a methoxy group, an ethoxy group, a chlorine atom or a bromide atom as a substituent) or a naphthyl group are preferred.

Of the compounds represented by the general formula (I), those wherein $Z_1$ forms a naphtho[1,2-d]thiazole nucleus, Y represents an oxygen atom, and $R_2$ represents a phenyl group, a tolyl group, an anisyl group, a chlorophenyl group or a naphthyl group are particularly preferred.

Of the compounds represented by the foregoing general formula (II), those represented by the following general formula (IIa) are preferred:

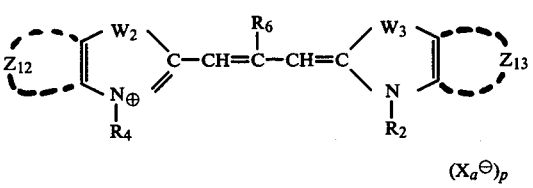

(IIa)

wherein $R_4$, $R_5$, $R_6$, $X_a$ and p are the same as defined in the general formula (II); $W_2$ represents a sulfur atom, a selenium atom, an oxygen atom or an $>NR_3$ group; $W_3$ represents an oxygen atom or an $>NR_3$ group; $R_3$ represents an alkyl group which may be substituted; $Z_{12}$ and $Z_{13}$, which may be the same or different, each represents the atoms necessary to complete a benzene ring or a naphthalene ring. The alkyl group represented by $R_3$ has 1 to 3 total carbon atoms which may be unsubstituted or substituted with one or more of an alkoxy group (e.g., having 1 to 6 carbon atoms), an alkoxycarbonyl group (e.g., having 2 to 6 carbon atoms), a carboxy group, a carbamoyl group, a cyano group, a halogen atom, a sulfo group, a phenyl group, a vinyl group, etc. Examples of substituted alkyl groups represented by $R_3$ are alkoxyalkyl groups such as a methoxyethyl group, an ethoxyethyl group, a methoxypropyl group, etc., alkoxycarbonylalkyl groups such as a methoxycarbonylmethyl group, an ethoxycarbonylmethyl group, an ethoxycarbonylethyl group, a butoxycarbonylethyl group, etc., carboxyalkyl groups such as a carboxymethyl group, a carboxyethyl group, a carboxypropyl group, etc., carbamoylalkyl groups such as a carbamoylethyl group, a carbamoylpropyl group, etc., cyanoalkyl groups such as a cyanoethyl group, a cyanopropyl group, etc., haloalkyl groups such as a trifluoroethyl group, a perfluoropropyl group, a chloroethyl group, a chloropropyl group, etc., sulfoalkyl groups such as a sulfoethyl group, a sulfopropyl group, etc., phenyl substituted alkyl groups such as a benzyl group, a phenethyl group, a phenylpropyl group, etc., and vinylalkyl groups such as an allyl group, etc. The benzene ring or naphthalene ring completed by $Z_{12}$ and $Z_{13}$ may be substituted with one or more substituents such as a cyano group, a trifluoromethyl group, an alkylcarbonylamino group (e.g., having 2 to 8 carbon atoms), an arylcarbonylamino group (e.g., having 7 to 8 carbon atoms), a halogen atom (e.g., a chlorine atom, a bromine atom, etc.), a carboxy group, an alkoxycarbonyl group (e.g., having 2 to 5 carbon atoms), an alkyl group (e.g., having 1 to 4 carbon atoms), a phenyl group, a hydroxy group, an alkoxy group (e.g., having 1 to 4 carbon atoms), an alkylenedioxy group (e.g., having 1 to 3 carbon atoms), an alkylcarbonyl group (e.g., having 2 to 5 carbon atoms), an alkylsulfonyl group (e.g., having 1 to 4 carbon atoms), an aralkyl group (e.g., having 7 to 10 carbon atoms), etc. Examples of these classes of substituents as described above are the same as those included in the previous description with respect to substituents on the $Z_2$ and $Z_3$ rings. Specific examples of the hetero ring nuclei comprising $W_2$ and $Z_{12}$ are as described hereinbefore with respect to $Z_2$ and specific examples of the hetero ring nuclei comprising $W_3$ and $Z_{13}$ are as described hereinbefore with respect to $Z_3$.

Preferred examples of compounds represented by the foregoing general formula (III) are compounds represented by the following general formula (IIIa):

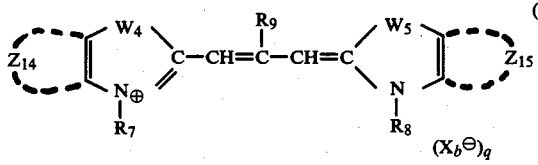

(IIIa)

wherein $R_7$, $R_8$, $R_9$, $X_b$ and q are the same as defined in the general formula (III); $W_4$ and $W_5$ each represents a sulfur atom or a selenium atom; $Z_{14}$ and $Z_{15}$, which may be the same or different, each represents the necessary atoms for completing a benzene ring or a naphthalene ring. The benzene ring or the naphthalene ring completed by $Z_{14}$ or $Z_{15}$ may be substituted with one or more substituents. Examples of suitable substituents are a halogen atom (e.g., a chlorine atom, a bromine atom, etc.), an unsubstituted alkyl group (e.g., having 1 to 4 carbon atoms such as a methyl group, an ethyl group, an n-propyl group, an n-butyl group, an isopropyl group, etc.), a carboxy group, an alkoxycarbonyl group (e.g., having 2 to 5 carbon atoms such as a methoxycarbonyl group, an ethoxycarbonyl group, a propoxycarbonyl group, a butoxycarbonyl group, etc.), a hydroxy group, a phenyl group, an alkoxy group (e.g., having 1 to 4 carbon atoms such as a methoxy group, an ethoxy group, a propoxy group, a butoxy group, etc.), an aralkyl group (e.g., having 7 to 10 carbon atoms such as a benzyl group, a phenethyl group, etc.), an alkylcarbonylamino group (e.g., having 2 to 5 carbon atoms such as an acetylamino group, a propionylamino group, etc.), etc.

Typical examples of the sensitizing dyes which can be used in the present invention are illustrated below. However, the present invention is not to be construed as being limited to these sensitizing dyes.

Specific examples of compounds represented by the general formula (I) are set forth below. The λ max shown for each of these examples of compounds represented by the general formula (I) was measured at a concentration of $2.5 \times 10^{-5}$ to $5 \times 10^{-5}$ mol/l.

(I-1) $\lambda_{max}^{MeOH}$ 400 nm

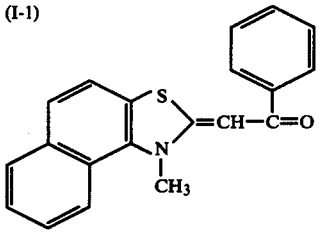

(I-2) $\lambda_{max}^{MeOH}$ 391 nm

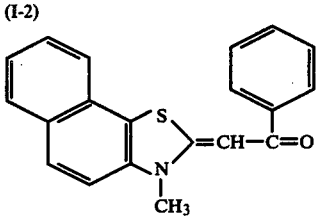

(I-3) $\lambda_{max}^{MeOH}$ 400 nm

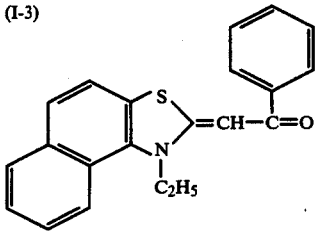

-continued (I-4) $\lambda_{max}^{MeOH}$ 401 nm

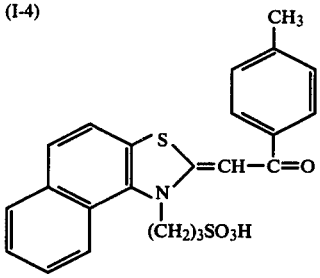

(I-5) $\lambda_{max}^{MeOH}$ 375 nm

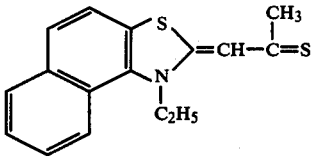

(I-6) $\lambda_{max}^{MeOH}$ 378 nm

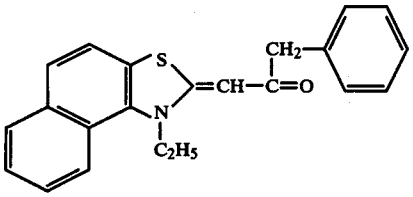

(I-7) $\lambda_{max}^{MeOH}$ 392 nm

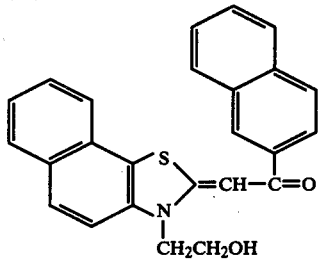

Specific examples of compounds represented by the foregoing general formula (II) are set forth below. The λ max shown for each of these examples of compounds represented by the general formula (II) was measured at a concentration of $7 \times 10^{-6}$ to $12 \times 10^{-6}$ mol/l.

(II-1) $\lambda_{max}^{MeOH}$ 498 nm

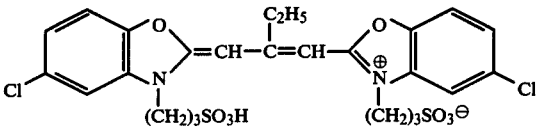

(II-2) $\lambda_{max}^{MeOH}$ 508 nm

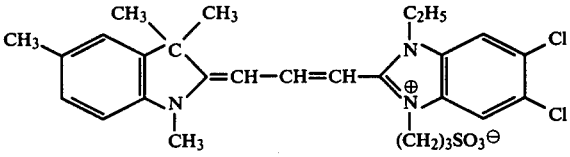

-continued
(II-3) $\lambda_{max}^{MeOH}$ 517 nm
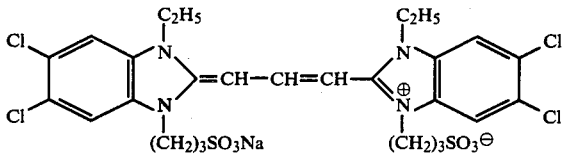
(II-4) $\lambda_{max}^{MeOH}$ 518 nm
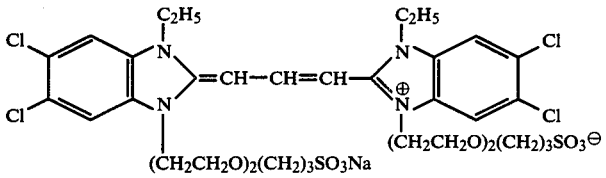
(II-5) $\lambda_{max}^{MeOH}$ 504 nm
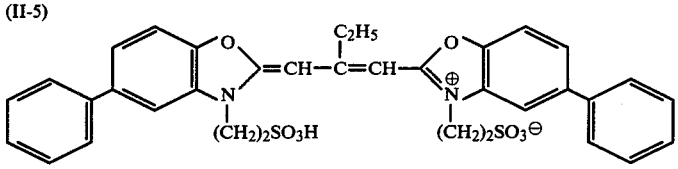
(II-6) $\lambda_{max}^{MeOH}$ 488 nm
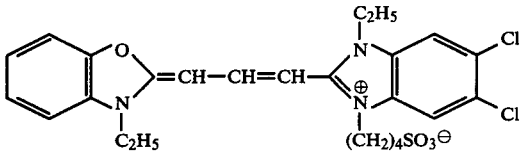
(II-7) $\lambda_{max}^{MeOH}$ 510 nm
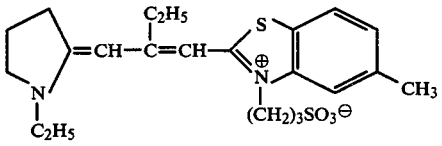
(II-8) $\lambda_{max}^{MeOH}$ 531 nm
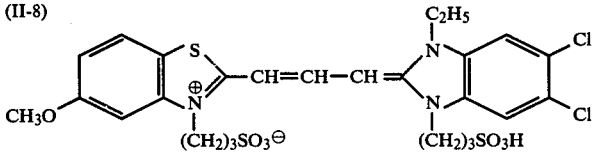
(II-9) $\lambda_{max}^{MeOH}$ 532 nm
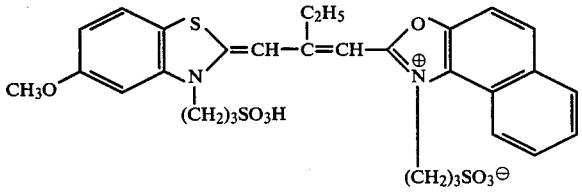
(II-10) $\lambda_{max}^{MeOH}$ 475 nm
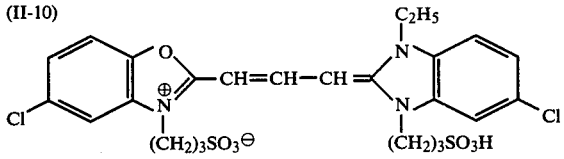

-continued
(II-11) $\lambda_{max}^{MeOH}$ 484 nm
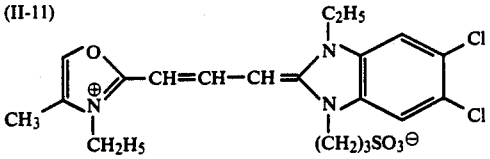
(II-12) $\lambda_{max}^{MeOH}$ 533 nm
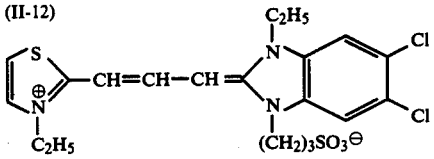
(II-13) $\lambda_{max}^{MeOH}$ 519 nm
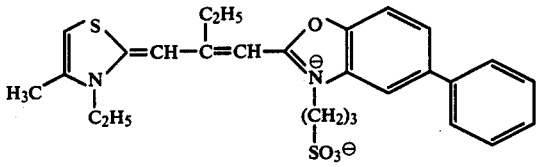
(II-14) $\lambda_{max}^{MeOH}$ 504 nm
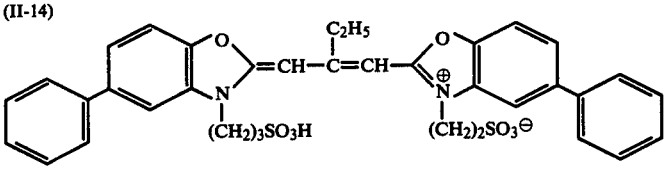
(II-15) $\lambda_{max}^{MeOH}$ 500 nm
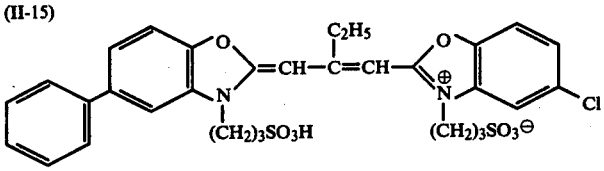
(II-16) $\lambda_{max}^{MeOH}$ 545 nm
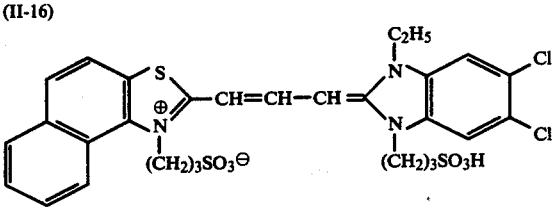
(II-17) $\lambda_{max}^{MeOH}$ 535.5 nm
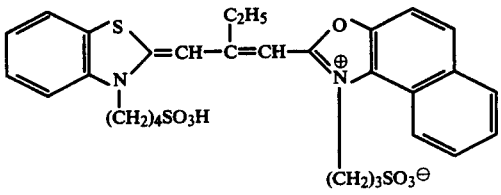
(II-18) $\lambda_{max}^{MeOH}$ 539 nm
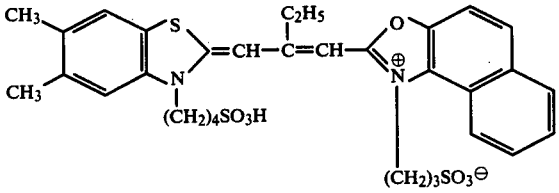

-continued (II-19) $\lambda_{max}^{MeOH}$ 537.5 nm

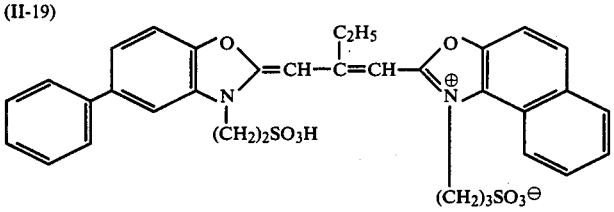

Specific examples of compounds represented by the foregoing general formula (III) are set forth below. The λ max shown for each of these examples of compounds represented by the general formula (III) was measured at a concentration of $7 \times 10^{-6}$ to $12 \times 10^{-6}$ mol/l.

(III-1) $\lambda_{max}^{MeOH}$ 545 nm

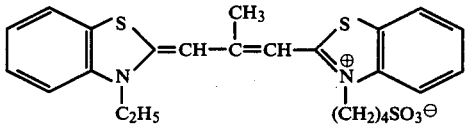

(III-2) $\lambda_{max}^{MeOH}$ 603 nm

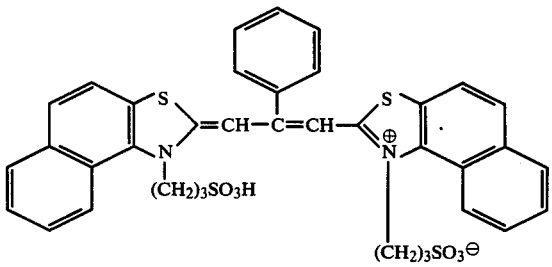

(III-3) $\lambda_{max}^{MeOH}$ 544 nm

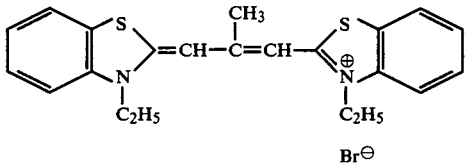

(III-4) $\lambda_{max}^{MeOH}$ 557 nm

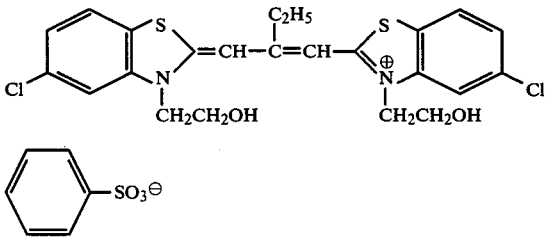

-continued
(III-5) $\lambda_{max}^{MeOH}$ 603 nm
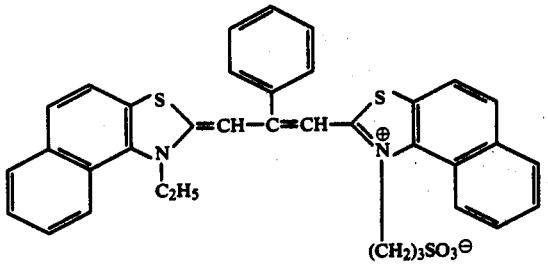
(III-6) $\lambda_{max}^{MeOH}$ 554 nm
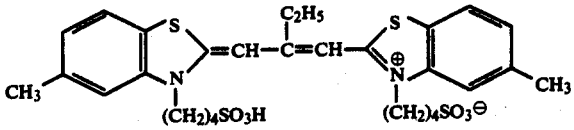
(III-7) $\lambda_{max}^{MeOH}$ 583 nm
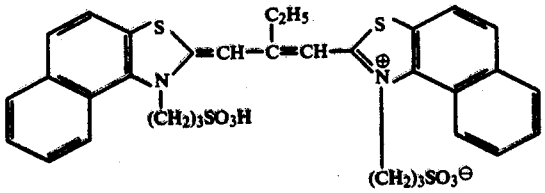
(III-8) $\lambda_{max}^{MeOH}$ 545 nm
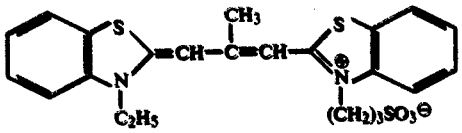
(III-9) $\lambda_{max}^{MeOH}$ 557 nm
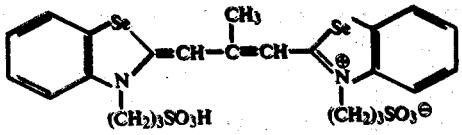
(III-10) $\lambda_{max}^{MeOH}$ 554 nm
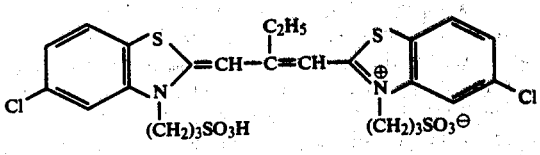

-continued (III-11) $\lambda_{max}^{MeOH}$ 557 nm

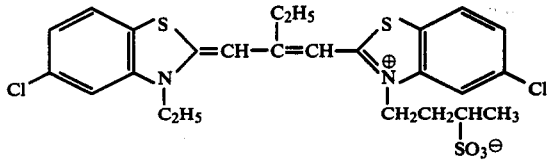

(III-12) $\lambda_{max}^{MeOH}$ 556 nm

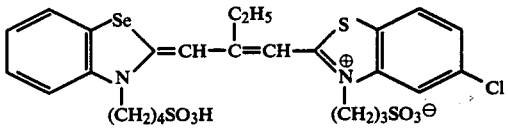

(III-13) $\lambda_{max}^{MeOH}$ 564 nm

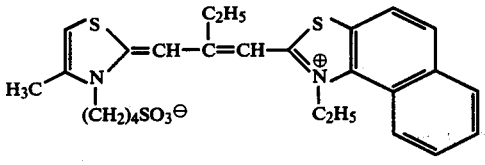

(III-14) $\lambda_{max}^{MeOH}$ 581 nm

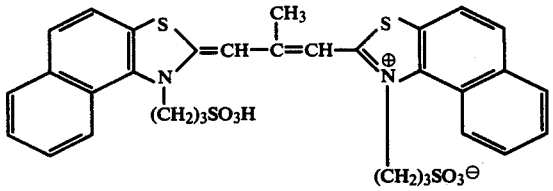

(III-15) $\lambda_{max}^{MeOH}$ 554 nm

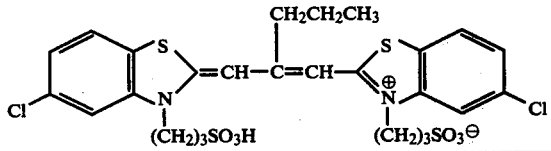

The compounds represented by the general formula (I) are known and are described in U.S. Pat. Nos. 2,112,139, 2,481,698 and 2,486,173, the compounds represented by the general formula (II) are known as described in French Patent Nos. 2,182,329 and 2,174,418, U.S. Pat. Nos. 3,679,428, 3,729,319, 3,338,714, 3,463,640, 3,931,156, 3,793,020, 3,656,959 and 2,912,329 and British Patent Nos. 1,328,288, 1,323,168, 1,327,808 and 840,223 and the compounds represented by the general formula (III) are known and described in U.S. Pat. Nos. 3,705,809, 3,770,449, 3,873,324, 3,432,303, 3,463,640, 3,743,517, 3,617,293, 3,677,765 and 3,177,210.

Each of the compounds represented by the general formula (I), (II) or (III) is incorporated in a silver halide emulsion in an amount of about $5 \times 10^{-7}$ mol to about $5 \times 10^{-3}$ mol, preferably $1 \times 10^{-6}$ mol to $2.5 \times 10^{-3}$ mol and, particularly preferably $5 \times 10^{-6}$ mol to $1 \times 10^{-3}$ mol, per mol of silver halide.

The optimum amount of the compounds of the present invention can be decided using techniques well known to those skilled in the art by separating the same emulsion into several portions, incorporating the compound in respective portions in different amounts, and measuring the sensitivity thereof.

The compounds can be added to an emulsion also using processes well known in the photographic art.

The compounds of the present invention may be directly dispersed in an emulsion or may be first dissolved in a watersoluble solvent such as pyridine, methyl alcohol, ethyl alcohol, methyl Cellosolve, acetone, etc., (or a mixture of such solvents) and, in some cases, diluting the solution with water or, in other cases, dissolving only in water, and adding the solution of the sensitizing dyes to an emulsion. In addition, it is also possible to employ ultrasonic vibration to aid in dissolution. Further, other processes described in, for example, Japanese Patent Publication Nos. 8231/70, 23389/69, 27555/69, 22948/69, German Patent Application (OLS)

No. 1,947,935, U.S. Pat. Nos. 3,485,634, 3,342,605, 2,912,343, etc., may also be used.

If necessary, the compounds of this invention may be separately dissolved in a suitable solvent and separately added to an emulsion, or they may be dissolved in the same or different solvents and the resulting solutions may be mixed before adding the solutions to a silver halide emulsion.

A silver halide emulsion containing the sensitizing compounds of this invention is coated on a suitable support such as a glass plate, a cellulose derivative film, a polyvinyl resin film (e.g., a polystyrene film, a polyvinyl chloride film, etc.), a polyester film, a synthetic paper, a baryta paper, a polyolefin film-coated photographic paper, etc. The addition of the compounds of the present invention to a silver halide emulsion may be conducted at any stage during the process of producing the emulsion, although it is convenient to add the compounds of this invention to the emulsion after second ripening.

The silver halide photographic emulsion used in the present invention can be produced in a conventional manner. For example, silver chloride, silver bromide, silver iodide or a mixed silver halide thereof precipitated according to the single jet process, the double jet process or a combined process thereof can be present in the emulsion. Preferred silver halides are silver bromoiodide, silver chlorobromide or silver chlorobromoiodide. Coarse silver halide grains or fine silver halide grains may be used as the silver halide, with those having a mean diameter of about 0.04 to 4$\mu$ (measured by, for example, the number-average projected area method) being preferred.

The silver halide grain size distribution may be narrow or broad, as desired.

The silver halide grains in the photographic emulsion may have a regular crystal form such as that of a cube or an octahedron, may have an irregular crystal form such as that of a sphere or plate, or may have a composite form thereof. They may comprise a mixture of various crystal forms.

The silver halide grains may have an inner portion and a surface layer which are different from each other or may comprise a uniform phase. In addition, they may be grains forming a latent image mainly on the surface of the grains or grains forming a latent image mainly inside of the grains.

The photographic emulsion used in the present invention can be prepared according to the processes described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsions,* The Focal Press (1964), etc. That is, those prepared using any of an acidic process, a neutral process, an ammoniacal process, etc., may be employed. The reacting of a soluble silver salt with a soluble halide can be using any of a single jet process, a double jet process, a combination thereof, etc.

Silver halide grains formed in the presence of excess silver ion (the so-called reverse-mixing process) can also be employed.

One type of simultaneous mixing process which can be used comprises maintaining the pAg in the liquid phase where the silver halide is formed, i.e., the so-called controlled double jet process. This process provides a silver halide emulsion containing silver halide grains with a regular crystal form having almost uniform grain sizes.

It is also possible to use two or more separately prepared silver halide emulsions, if desired.

The photographic emulsion of the present invention may contain color image-forming couplers, i.e., compounds capable of reacting with an oxidation product of an aromatic amine (usually an aromatic primary amine) developing agent to form a dye (hereinafter "couplers"). Non-diffusible couplers which have a hydrophobic group, called a ballast group, within the molecule are desirable. The couplers may be the 4-equivalent type or the 2-equivalent type with respect to silver ion. In addition, the photographic emulsion may contain colored couplers having the effect of color correction or couplers capable of releasing a development inhibitor upon development (the so-called DIR couplers). Also, couplers which form colorless products as a result of the coupling reaction may be present in the emulsion.

Known open-chain ketomethylene couplers can be used as yellow couplers. Of these couplers, benzoylacetanilide compounds and pivaloylacetanilide compounds are advantageous. Specific examples of suitable yellow couplers are described in U.S. Pat. Nos. 2,875,057, 3,265,506, 3,408,194, 3,551,155, 3,582,322, 3,725,072, 3,891,445, West German Patent No. 1,547,868, West German Patent Application (OLS) Nos. 2,213,461, 2,219,917, 2,261,361, 2,263,875, 2,414,006, etc.

Pyrazolone compounds, indazolone compounds, cyanoacetyl compounds, etc., can be used as magenta color couplers. In particular, pyrazolone compounds are advantageous as magenta couplers. Specific examples of suitable magenta color couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Patent No. 1,810,464, West German Patent Application (OLS) Nos. 2,408,665, 2,417,945, 2,418,959, 2,424,467, Japanese Patent Publication No. 6031/65, etc.

Phenolic compounds, naphtholic compounds, etc., can be used as cyan color couplers. Specific examples of suitable cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, West German Patent Application (OLS) Nos. 2,414,830, 2,454,329, Japanese Patent Application (OPI) No. 59838/73, etc.

As colored couplers, those couplers described in, for example, U.S. Pat. Nos. 3,476,560, 2,521,908, 3,034,892, Japanese Patent Application (OPI) Nos. 2016/69, 22335/63, 11304/67, 32461/69, Japanese Patent Application Nos. 98469/74, 118029/75, West German Patent Application (OLS) No. 2,418,959, etc., can be used.

As the DIR couplers, those couplers described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Patent No. 953,454, Japanese Patent Application No. 146570/75, etc., can be used.

In addition to the DIR couplers, those compounds which release a development inhibitor upon development can be incorporated in the light-sensitive material. For example, those compounds described in U.S. Pat. Nos. 3,297,445, 3,379,529 and West German Patent Application (OLS) No. 2,417,914 can be used.

Two or more of the above-described couplers can be incorporated in the same layer. Also, the same compound can be incorporated in two or more different layers, if desired.

The couplers can be incorporated in a silver halide emulsion layer using known processes described in, for example, U.S. Pat. No. 2,322,027. For example, the couplers are dissolved in a high boiling solvent such as an alkyl phthalate (e.g., dibutyl phthalate, dioctyl phthalate, etc.), a phosphate (e.g., diphenyl phosphate, triphenylphosphate, tricresyl phosphate, dioctylbutyl phosphate), a citrate (e.g., tributyl acetylcitrate, etc.), a benzoate (e.g., octyl benzoate, etc.), an alkylamide (e.g., diethyllaurylamide, etc.) or in a low boiling organic solvent having a boiling point of from about 30° C. to about 150° C., such as a lower alkyl acetate (e.g., ethyl acetate, butyl acetate, etc.), ethyl propionate, sec-butyl alcohol, methyl isobutyl ketone, $\beta$-ethoxyethyl acetate, methyl Cellosolve acetate, etc., then dispersed in a hydrophilic colloid. It is also possible to use a mixture of the above-described high-boiling organic solvent with the above-described low-boiling organic solvent.

Couplers having an acid group such as a carboxylic acid or sulfonic acid group can be incorporated into a hydrophilic colloid as an alkaline aqueous solution.

These couplers are generally added in an amount of about $2 \times 10^{-3}$ mol to about $5 \times 10^{-1}$ mol, preferably $1 \times 10^{-2}$ mol to $5 \times 10^{-1}$ mol, per mol of silver in the emulsion layer.

The exposure for obtaining a photographic image is conducted in a usual manner. That is, any known light sources such as natural light (sunlight), a tungsten lamp, a fluorescent lamp, a mercury lamp, a xenon arc lamp, a carbon arc lamp, a xenon flash lamp, a cathode ray tube flying spot, etc., can be used. A suitable exposure time is about 1/1,000 second to about 1 second as employed in an ordinary camera and, in addition, an exposure time of shorter than about 1/1,000 second (e.g., $1/10^4$ to $1/10^6$ second using a xenon flash lamp or a cathode ray tube) or an exposure time of longer than about 1 second can be employed. The spectral composition of the light used for the exposure can be adjusted, if necessary, by using a color filter. Laser light can also be used for the exposure. In addition, the exposure may be conducted using light emitted from a fluorescent body excited with electron beams, X-rays, $\gamma$-rays, $\alpha$-rays, etc.

A photographic material containing a layer comprising the photographic emulsion of the present invention can be photographically processed using any known processes. Known processing solutions can be used. Processing temperatures are usually selected between about 18° C. and about 50° C., but temperatures lower than about 18° C. or higher than about 50° C. can be used. Either development processing for forming a silver image (black-and-white photographic processing) or color photographic processing comprising development for forming a dye image is appropriate depending upon the end-use.

The developer used for black-and-white photographic processing can contain a known developing agent. Dihydroxybenzenes (e.g., hydroquinone, etc.), 3-pyrazolidones (e.g., 1-phenyl-3-pyrazolidone, etc.), aminophenols (e.g., N-methyl-p-aminophenol, etc.), 1-phenyl-3-pyrazolines, ascorbic acid, etc., can be used alone or in combination as the developing agent. In general, the developer may further contain a known preservative, an alkali agent, a pH buffer, an anti-fogging agent, etc., and, if necessary, a dissolving aid, a toning agent, a development accelerator, a surface active agent, a defoaming agent, a water softener, a hardener, a viscosity-imparting agent, etc.

A so-called "lithographic type" development processing can be applied to the photographic emulsion of the present invention. "Lithographic type" development processing as used herein means a development processing for photographically reproducing line images or for photographically reproducing half-tone images through dots, which comprises usually employing a dihydroxybenzene as a developing agent and conducting an infectious development at low sulfite ion concentration. (Detailed descriptions of infectious development are given in L. F. A. Mason, *Photographic Processing Chemistry*, pp. 163–165, The Focal Press (1966).)

Generally known fixing solutions can be used.

Suitable fixing agents include thiosulfates, thiocyanates and, in addition, organic sulfur compounds which are known to exhibit a fixing effect can be used.

The fixing solution may contain a water-soluble aluminum salt as a hardener. In the case of forming dye images, ordinary processes are applicable.

A negative-positive process (described in, e.g., *Journal of the Society of Motion Picture and Television Engineers*, 61, pp. 667–701 (1953)), a color reversal process for obtaining dye positive images, which comprises forming a negative silver image by developing with a developer containing a black-and-white developing agent, then conducting a uniform exposure at least once or conducting another appropriate fogging processing, followed by conducting color development, a silver dye bleaching process which comprises developing an exposed photographic emulsion layer containing dyes to form a silver image, and bleaching the dyes using the silver image as a bleaching catalyst, and the like can be used.

A color developer generally comprises an alkaline aqueous solution containing a color developing agent. Examples of color developing agents which can be used include known primary aromatic amine developing agents such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.).

The present invention will now be illustrated in more detail by the following non-limiting examples of preferred embodiments of the present invention. Unless otherwise indicated herein, all parts, percents, ratios and the like are by weight.

EXAMPLES

Silver halide grains were precipitated according to a single jet process, and physically ripened, desalted, and chemically ripened to obtain a silver bromoiodide emulsion (iodide content: 8 mol%). The mean diameter of the silver halide grains contained in this emulsion was 0.7$\mu$. 0.52 mol of silver halide was present per kg of the emulsion.

1 kg portions of this emulsion were weighed out in vessels, and melted over a water bath at 50° C. Methanol solutions of the sensitizing dyes of the present invention were added thereto in given amounts, and stirred and mixed in a thermostatic bath at 40° C. 10 ml of a 1% by weight aqueous solution of 4-hydroxy-6-methyl-1,3,3*a*,7-tetrazaindene, 20 ml of a 1% by weight aqueous solution of 2-hydroxy-4,6-dichlorotriazine sodium salt were added thereto, and the mixture stirred. Each of these finished emulsions was coated on a cellulose triacetate film support in a dry thickness of 5μ to obtain samples of light-sensitive materials. These film samples were cut into strips. One strip was subjected to a wedge exposure using a sensitometer having a light source of a color temperature of 5400° C. through a yellow filter (SC-50) made by the Fuji Photo Film Co., Ltd. or a blue filter (Wratten 47B) made by Eastman Kodak Co. The exposure conditions were an illuminance of 256 lux and an exposure time of 1/20 second.

The exposed samples were developed in a developer having the following composition at 20° C. for 7 minutes and dipped in a fixing solution having the following composition at 20° C. for 5 minutes and then washed with tap water for 30 minutes.

| | | |
|---|---|---|
| Composition of Developer | | |
| Water | 700 | ml |
| Monomethyl-p-aminophenol | 2 | g |
| (½sulfate) | 2 | g |
| Sodium Sulfite (anhydrous) | 100 | g |
| Hydroquinone | 5 | g |
| Borax (pentahydrate) | 1.5 | g |
| Water to make | 1 | l |
| Composition of Fixing Solution | | |
| Sodium Thiosulfate | 240 | g |
| Hardening Solution | 50 | ml |
| Water | 1 | l |
| Composition of the Hardening Solution | | |
| Sodium Sulfite (anhydride) | 60 | g |
| Glacial Acetic Acid | 100 | ml |
| Potassium Alum | 120 | g |
| Water | 1 | l |

The photographic density was measured using a Model P densitometer made by the Fuji Photo Film Co., Ltd. to determine the yellow light sensitivity ($S_y$) and the blue light sensitivity ($S_B$). In order to determine the sensitivity, the point of an optical density of (fog + 0.20) was used.

The thus-obtained results are tabulated by groups as relative values in Tables 1 to 6 below.

TABLE 1

| Run No. | Sensitizing Dye & Amount Thereof Added (× $10^{-5}$ mol/kg emulsion) | | | | | | Photographic Characteristics $S_y$ | $S_B$ | Fog |
|---|---|---|---|---|---|---|---|---|---|
| 1 | (I-1) | 8 | (II-1) | 3 | — | — | 275 | 93 | 0.05 |
| 2 | (I-1) | 8 | — | — | (III-10) | 13 | 1120 | 87 | 0.06 |
| 3 | — | — | (II-1) | 3 | (III-10) | 13 | 1050 | 91 | 0.06 |
| 4 | (I-1) | 8 | (II-1) | 3 | (III-10) | 13 | 1350 | 89 | 0.06 |
| 5 | (A) | 8 | (II-1) | 3 | (III-10) | 13 | 890 | 83 | 0.06 |

Comparison Compound (A)

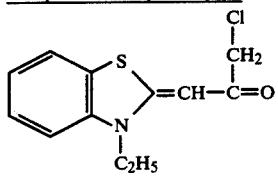

(A)

TABLE 2

| Run No. | Sensitizing Dye & Amount Thereof Added (× $10^{-5}$ mol/kg emulsion) | | | | | | Photographic Characteristics $S_Y$ | $S_B$ | Fog |
|---|---|---|---|---|---|---|---|---|---|
| 6 | (I-2) | 6 | (II-15) | 6 | — | 13 | 100 | 105 | 0.06 |
| 7 | (I-2) | 6 | — | — | (III-8) | 6 | 184 | 100 | 0.05 |
| 8 | — | — | (II-15) | 6 | (III-8) | 6 | 184 | 100 | 0.06 |
| 9 | (I-2) | 6 | (II-15) | 6 | (III-8) | 6 | 300 | 100 | 0.06 |

TABLE 3

| Run No. | Sensitizing Dye & Amount Thereof Added (× $10^{-5}$ mol/kg emulsion) | | | | | | Photographic Characteristics $S_Y$ | $S_B$ | Fog |
|---|---|---|---|---|---|---|---|---|---|
| 10 | (I-1) | 10 | (II-3) | 3 | — | — | 123 | 85 | 0.05 |
| 11 | (I-1) | 10 | — | — | (III-6) | 6 | 362 | 87 | 0.05 |
| 12 | — | — | (II-3) | 3 | (III-6) | 6 | 302 | 85 | 0.05 |
| 13 | (I-1) | 10 | (II-3) | 3 | (III-6) | 6 | 458 | 85 | 0.05 |

TABLE 4

| Run No. | Sensitizing Dye & Amount Thereof Added (× $10^{-5}$ mol/kg emulsion | | | | | | Photographic Characteristics $S_Y$ | $S_B$ | Fog |
|---|---|---|---|---|---|---|---|---|---|
| 14 | (I-1) | 8 | (II-16) | 3 | — | — | 107 | 83 | 0.05 |
| 15 | (I-1) | 8 | — | — | (III-11) | 13 | 195 | 87 | 0.06 |
| 16 | — | — | (II-16) | 3 | (III-11) | 13 | 240 | 83 | 0.06 |
| 17 | (I-1) | 8 | (II-16) | 3 | (III-11) | 13 | 302 | 91 | 0.06 |

TABLE 5

| Run No. | Sensitizing Dye & Amount Thereof Added ( × $10^{-5}$ *mol/kg emulsion*) | | | | | | Photographic Characteristics $S_Y$ | $S_B$ | Fog |
|---|---|---|---|---|---|---|---|---|---|
| 18 | (I-1) | 16 | (II-8) | 7 | — | — | 110 | 93 | 0.05 |
| 19 | (I-1) | 16 | — | — | (III-14) | 3 | 74 | 76 | 0.05 |
| 20 | — | — | (II-8) | 7 | (III-14) | 3 | 166 | 83 | 0.05 |
| 21 | (I-1) | 16 | (II-8) | 7 | (III-14) | 3 | 190 | 90 | 0.05 |

TABLE 6

| Run No. | Sensitizing Dye & Amount Thereof Added ( × $10^{-5}$ mol/kg emulsion) | | | | | | Photographic Characteristics $S_Y$ | $S_B$ | Fog |
|---|---|---|---|---|---|---|---|---|---|
| 22 | (I-1) | 8 | (II-12) | 6 | — | — | 129 | 100 | 0.05 |
| 23 | (I-1) | 8 | — | — | (III-1) | 6 | 175 | 100 | 0.05 |
| 24 | — | — | (II-12) | 6 | (III-1) | 6 | 188 | 98 | 0.05 |
| 25 | (I-1) | 8 | (II-12) | 6 | (III-1) | 6 | 210 | 100 | 0.05 |

The supersensitizing effect of the dyes of the present invention can be easily seen from the results in Tables 1 to 6 above. For example, in Table 1, it can be seen that the combination of the three dyes provides the highest sensitivity as compared with that obtained by the combinations of any of two of the dyes. It is apparent from the results in using Comparative Compound (A) (Run No. 5) that a combination with any compound does not necessarily provide increased sensitivity. Excellent effects of the combined use of three dyes are also seen from the results in Tables 2 to 6.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing, in supersensitizing amounts, the combination of at least one compound represented by the following general formula (I):

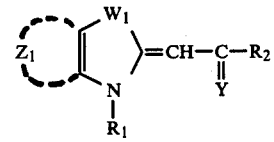

(I)

wherein $Z_1$ represents the atoms necessary for forming a benzene ring or a naphthalene ring; $W_1$ represents a sulfur atom or a selenium atom; Y represents an oxygen atom or a sulfur atom; $R_1$ represents an alkyl group or an aryl group; and $R_2$ represents a lower alkyl group having 1 to 6 carbon atoms in the alkyl moiety or an aryl group at least one carbocyanine dye represented by the following general formula (II):

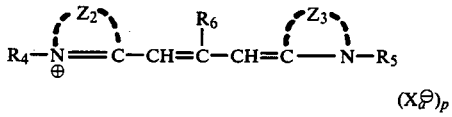

(II)

wherein $Z_2$ represents the atoms necessary for forming a thiazole ring, a selenazole ring, an oxazole ring, an imidazole ring or a pyrroline ring; $Z_3$ represents the atoms necessary for forming an oxazole ring or an imidazole ring; $R_4$ and $R_5$, which may be the same or different, each represents an alkyl group; $R_6$ represents a hydrogen atom or a lower alkyl group having 1 to 6 carbon atoms in the alkyl moiety; $X_a^{\ominus}$ represents an acid anion; and p represents 0 or 1 and, when an inner salt is formed, p represents 0; and at least one dye represented by the following general formula (III):

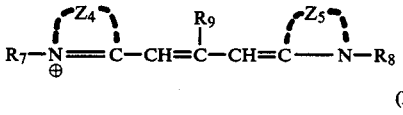

(III)

wherein $Z_4$ and $Z_5$, which may be the same or different, each represents the atoms necessary for forming a thiazole ring or a selenazole ring; $R_7$ and $R_8$, which may be the same or different, each represents an alkyl group; $R_9$ represents a hydrogen atom, a lower alkyl group having 1 to 6 carbon atoms in the alkyl moiety or an aryl group; $X_b^{\ominus}$ represents an acid anion; and q represents 0 or 1 and, when an inner salt is formed, q represents 0.

2. The silver halide photographic emulsion of claim 1, wherein the ring formed by $Z_1$ is an unsubstituted ring or a ring substituted with one or more of an alkyl group having 1 to 10 carbon atoms, an alkoxy group having 1 to 8 carbon atoms, a halogen atom, a cyano group, a phenyl group, an alkylcarbonyl group having 2 to 8 carbon atoms, an arylcarbonyl group having 7 to 8 carbon atoms, a methylenedioxy group, a phenoxy group, an aralkyl group having 7 to 12 carbon atoms, an alkoxycarbonyl group having 2 to 6 carbon atoms, an alkylcarbonylamino group having 2 to 8 carbon atoms, an arylcarbonylamino group having 7 to 8 carbon atoms, a carbamoyl group having 1 to 8 carbon atoms, a carboxy group, and a hydroxy group;

the alkyl group represented by $R_1$ has 1 to 20 carbon atoms, may be straight chain, branched chain or cyclic, and may be substituted with one or more of a vinyl group, a sulfo group, a carboxy group, an aryl group, a mono- or di-substituted amino group, a hydroxy group, an alkoxy group, an aryloxy group, an alkoxycarbonyl group, an alkylcarbonyloxy group, an arylcarbonyloxy group, a halogen atom, an alkylcarbonyl group, an arylcarbonyl group, an alkylsulfonyl group, an arylsulfonyl group, a carbamoyl group, and a cyano group;

the aryl group represented by $R_1$ and $R_2$ is a monocyclic or bicyclic aryl group which may be substituted with one or more of an alkyl group, a sulfo group, a carboxy group, a halogen atom, an alkoxy group and a dialkylamino group;

the lower alkyl group represented by $R_2$ having 1 to 6 carbon atoms may be a straight chain, branched chain or cyclic alkyl group and may be substituted with one or more of a carboxy group, a cyano group, a fluorine atom, a phenyl group and an alkoxy group;

the thiazole ring, the selenazole ring, the oxazole ring and the pyrroline ring formed by $Z_2$ and the oxazole ring formed by $Z_3$ may be a single ring or a ring condensed with an aromatic ring or an aliphatic ring and which single ring or condensed ring may be substituted with one or more of a halogen atom, an alkyl group, a carboxy group, an alkoxycarbonyl group, a hydroxy group, a phenyl group, an alkoxy group, an alkenylenedioxy group, an aralkyl group, and an acylamino group;

the imidazole ring formed by $Z_2$ and $Z_3$ may be a single ring or a ring condensed with an aromatic ring and which single ring or condensed ring may be substituted in the 1-position thereof with one or more of a halogen atom, a cyano group, a trifluoromethyl group, an alkylsulfonyl group, an alkoxycarbonyl group, a carboxy group and an alkylcarbonyl group;

the thiazole ring and the selenazole ring formed by $Z_4$ and $Z_5$ may be a single ring or a single ring condensed with an aromatic ring or an aliphatic ring, which single ring or condensed ring may be substituted with one or more of the substituents described above with respect to $Z_2$ and $Z_3$;

the alkyl group represented by $R_4$, $R_5$, $R_7$ and $R_8$ is as defined above with respect to the alkyl group of $R_1$;

the lower alkyl group having 1 to 6 carbon atoms for $R_6$ and $R_9$ is as defined above for the lower alkyl group having 1 to 6 carbon atoms for $R_2$;

the aryl group for $R_9$ is as defined above for the aryl group of $R_1$; and the acid anion represented by $X_a$ and $X_b$ is a chloride ion, a bromide ion, an iodide ion, a perchlorate ion, a benzenesulfonate ion, a tosylate ion, a methylsulfate ion, an ethylsulfate ion or a thiocyanate ion.

3. The silver halide photographic emulsion of claim 2, wherein $Z_2$ and $Z_3$ forms a thiazole ring, a benzothiazole ring, a naphthothiazole ring, an oxazole ring, a benzoxazole ring, a naphthoxazole ring, a pyrroline ring, a 3,3-dialkylindolenine ring, an imidazole ring, benzimidazole ring or a naphthimidazole ring;

$Z_4$ and $Z_5$ forms a thiazole ring, a benzothiazole ring, a naphthothiazole ring, a selenazole ring, a benzoselenazole ring or a naphthoselenazole ring.

4. The silver halide photographic emulsion of claim 1, wherein the general formula (I), Y represents an oxygen atom and $R_2$ represents a phenyl group which may be substituted with a methyl group, an ethyl group, an isopropyl group, a methoxy group, an ethoxy group, a chlorine atom or a bromine atom, or a naphthyl group.

5. The silver halide photographic emulsion of claim 1, wherein in the general formula (I), $Z_1$ forms a naphtho[1,2-d]thiazole ring, Y represents an oxygen atom, and $R_2$ represents a phenyl group, a tolyl group, a chlorophenyl group or a naphthyl group.

6. The silver halide photographic emulsion of claim 1, wherein said compound of the general formula (II) has the general formula (IIa):

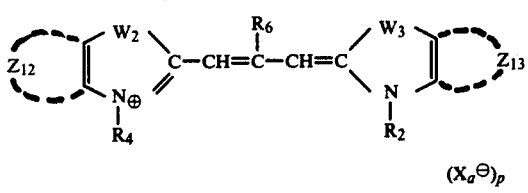

(IIa)

wherein $R_4$, $R_5$, $R_6$, $X_a$ and p are the same as defined in the general formula (II); $W_2$ represents a sulfur atom, a selenium atom, an oxygen atom or an $>NR_3$ group; $W_3$ represents an oxygen atom or an $>NR_3$ group; $R_3$ represents an alkyl group having 1 to 3 carbon atoms which may be substituted with one or more of an alkoxy group, an alkoxycarbonyl group, a carboxy group, a carbamoyl group, a cyano group, a halogen atom, a sulfo group, a phenyl group, and a vinyl group; $Z_{12}$ and $Z_{13}$, which may be the same or different, each represents the atoms necessary to complete a benzene ring or a naphthalene ring, which may be substituted with one or more of a cyano group, a trifluoromethyl group, a halogen atom, a carboxy group, an alkoxycarbonyl group, an alkyl group, a phenyl group, a hydroxy group, an alkoxy group, an alkylenedioxy group, an alkylcarbonyl group, an alkylsulfonyl group, and an aralkyl group.

7. The silver halide photographic emulsion of claim 1, wherein said compound of the general formula (III) is a compound represented by the general formula (IIIa):

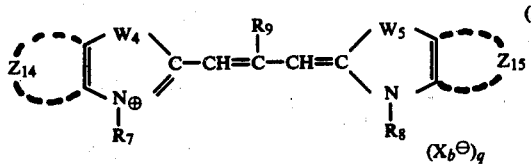

(IIIa)

wherein $R_7$, $R_8$, $R_9$, $X_b$ and q are the same as defined in the general formula (III); $W_4$ and $W_5$ each represents a sulfur atom or a selenium atom; $Z_{14}$ and $Z_{15}$, which may be the same or different, each represents the atoms necessary for completing a benzene ring or a naphthalene ring, which may be substituted with one or more of an alkyl group, a halogen atom, a carboxy group, an alkoxycarbonyl group, a hydroxy group, a phenyl group, an alkoxy group, an aralkyl group and an alkylcarbonylamino group.

8. The silver halide photographic emulsion of claim 1, wherein said compound represented by the general formula (I) is:

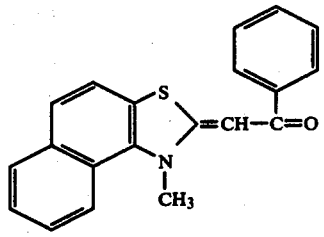

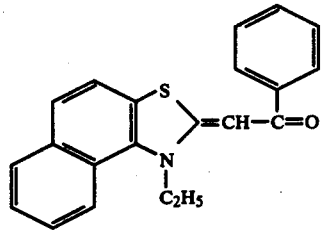

or

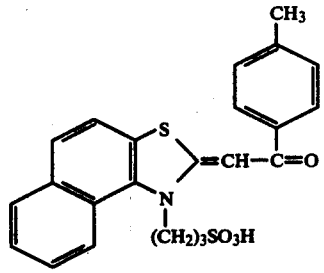

wherein said compound represented by the general formula (II) is:

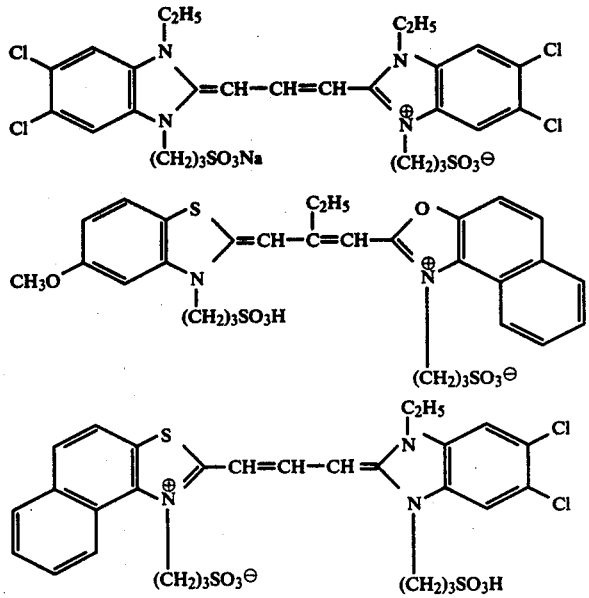

-continued

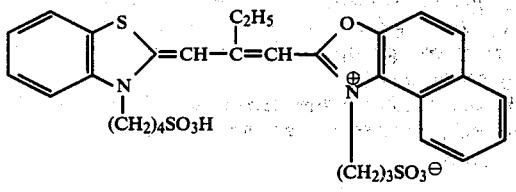

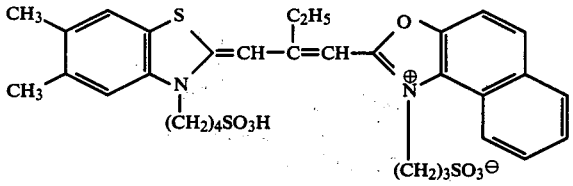

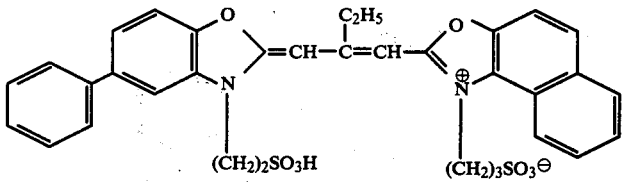

and wherein said compound represented by the general formula (III) is:

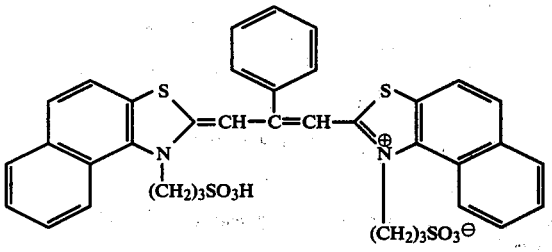

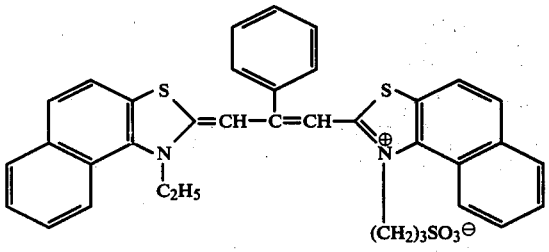

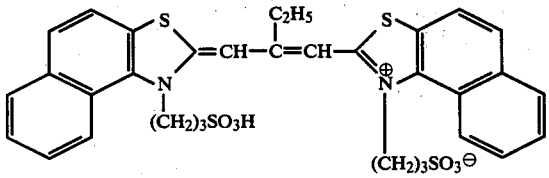

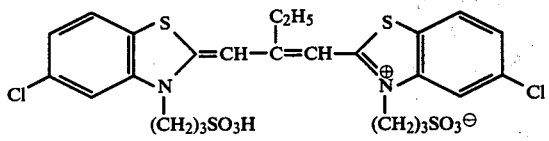

-continued

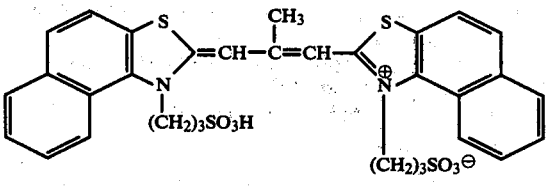

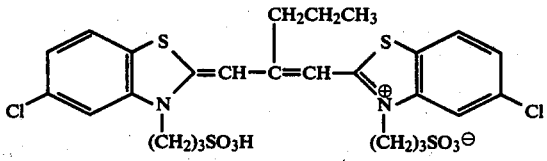

9. The silver halide photographic emulsion of claim 1, wherein each of the compounds represented by the general formulae (I), (II) and (III) is present in the silver halide emulsion in an amount of about $5 \times 10^{-7}$ mol to about $5 \times 10^{-3}$ mol per mol of silver halide in said emulsion.

10. A light-sensitive silver halide photographic material comprising a support having thereon at least one layer of the silver halide photographic emulsion of claim 1.

11. The silver halide photographic emulsion of claim 1, wherein Y is sulfur.

12. The silver halide photographic emulsion of claim 1, wherein $R_1$ is said aryl group.

13. The silver halide photographic emulsion of claim 1, wherein the compound represented by formula (I) has the formula:

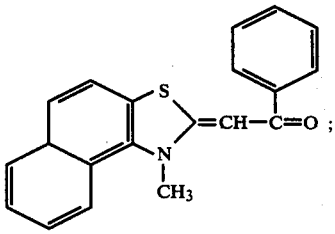

the dye of formula (II) has the formula:
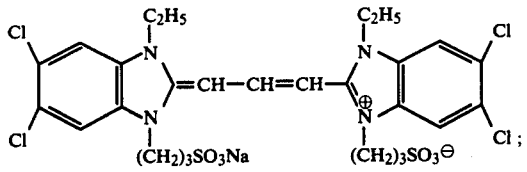
and
the dye of formula (III) has the formula:
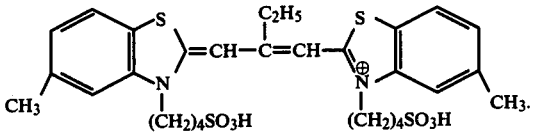
14. The silver halide photographic emulsion of claim 1, wherein the compound represented by formula (I) has the formula:
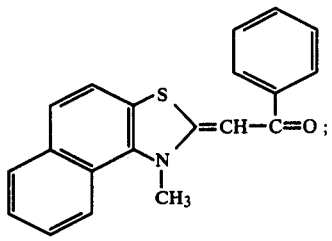
the dye of formula (II) has the formula:
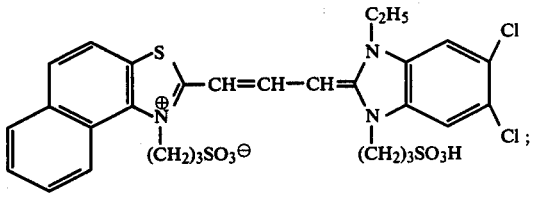
and
the dye of formula (III) has the formula:
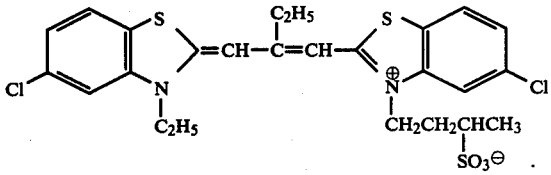
* * * * *